US006431703B2

(12) United States Patent
Rousseau et al.

(10) Patent No.: US 6,431,703 B2
(45) **Date of Patent: *Aug. 13, 2002**

(54) APPARATUS AND METHOD FOR IMPROVED LIFE SENSING IN A REPLACEABLE INTERMEDIATE TRANSFER SURFACE APPLICATION ASSEMBLY

(75) Inventors: Gerard H. Rousseau, Portland; Larry E. Hindman, Woodburn; David W. Johnson, Tigard; Brent R. Jones, Tualatin, all of OR (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/139,602

(22) Filed: Aug. 25, 1998

Related U.S. Application Data

(63) Continuation-in-part of application No. 08/961,813, filed on Oct. 31, 1997.

(51) Int. Cl.[7] ..... B41J 2/01
(52) U.S. Cl. ..... 347/103; 347/101; 347/19
(58) Field of Search ..... 347/101, 103, 347/19

(56) References Cited

U.S. PATENT DOCUMENTS

| | | | | |
|---|---|---|---|---|
| 3,968,770 | A | 7/1976 | Maars | 118/227 |
| 3,989,005 | A | 12/1976 | Bowler, Jr. et al. | 118/60 |
| 4,158,498 | A | 6/1979 | Ohmori | 355/15 |
| 4,400,079 | A | 8/1983 | Landa | 355/10 |
| 4,535,156 | A | 8/1985 | Durkee et al. | 346/21 |

(List continued on next page.)

FOREIGN PATENT DOCUMENTS

| | | | | |
|---|---|---|---|---|
| EP | 0395320 | A1 * | 10/1990 | G03G/15/00 |
| EP | 0395320 | A1 * | 10/1990 | G03G/15/00 |
| EP | 0395320 | A1 | 10/1990 | |
| EP | 525114 | B1 | 4/1991 | |
| EP | 583168 | A2 | 8/1993 | |
| EP | 0914946 | A2 | 5/1999 | |
| GB | 2242867 | | 2/1991 | |
| JP | 1446750 | | 3/1987 | |
| NL | 7512307 | | 12/1975 | |

OTHER PUBLICATIONS

"Innovative Release Agent Delivery System"; Richard Bucher, Alex Hobson and Hiroyasu Kikukawa; Eleventh International Congress on Advances in Non–Impact Printing Technologies of the Society for Imaging Science and Technology, Oct. 29, 1995, pp. 219–222.

"Gore Fuser Oiler Device"; publication of W.L. Gore and Associates, 1995.

"Fluoropolymer Coatings for Silicone Based Rolls"; publication of W.L. Gore and Associates, 1995.

U.S. Appl. Ser. No. 08/097,332, filed Jul. 23, 1993.

U.S. Appl. Ser. No. 08/845,551, filed Apr. 24, 1997.

*Primary Examiner*—John Barlow
*Assistant Examiner*—Manish S Shah
(74) *Attorney, Agent, or Firm*—Philip T. Virga

(57) ABSTRACT

An improved replaceable liquid application system for applying a liquid intermediate transfer surface to a support surface in a printer is provided. The liquid application system is contained in a removable cassette and utilizes a liquid impregnated arcuate surface that engages the support surface by rolling contact. The liquid impregnated arcuate surface and a reclamation assembly are contained in a removable cartridge in the cassette. A cartridge life status assembly determines when the useful life of the cartridge has been exhausted. Push tabs on the cartridge and finger wells on the cassette allow for easy and convenient removal of a used cartridge and insertion of a replacement cartridge.

15 Claims, 8 Drawing Sheets

U.S. PATENT DOCUMENTS 4,673,303 A 6/1987 Sansone et al. ..... 400/126
4,851,875 A 7/1989 Tanimoto ..... 355/245
4,961,088 A 10/1990 Gilliland et al. ..... 355/206
4,994,853 A 2/1991 Fukuchi et al.
5,019,868 A 5/1991 Kubert et al. ..... 355/264
5,021,828 A 6/1991 Yamaguchi et al.
5,049,898 A * 9/1991 Arthur et al. ..... 347/19
5,099,256 A 3/1992 Anderson ..... 346/1.1
5,389,958 A 2/1995 Bui et al. ..... 347/103
5,802,420 A * 9/1998 Garr et al. ..... 347/19
5,808,645 A * 9/1998 Reeves et al. ..... 347/103
6,158,837 A * 12/2000 Hilton et al. ..... 347/19

* cited by examiner

APPARATUS AND METHOD FOR IMPROVED LIFE SENSING IN A REPLACEABLE INTERMEDIATE TRANSFER SURFACE APPLICATION ASSEMBLY

This application is a C-I-P of Ser. No. 08/961,813 filed Oct. 31, 1997.

TECHNICAL FIELD

The present invention relates generally to offset or indirect printing, and more particularly to an improved apparatus for applying an intermediate liquid transfer surface to a support surface in an offset ink jet printer.

BACKGROUND OF THE INVENTION

It is known to utilize intermediate transfer surfaces in ink jet printing systems, such as the one disclosed in U.S. Pat. No. 5,389,958 entitled IMAGING PROCESS and assigned to the assignee of the present application. This patent discloses an offset ink jet printing system in which an intermediate transfer drum is employed with a print head. A liquid intermediate transfer surface is applied to the transfer drum. Nozzles in the print head eject drops of ink onto the liquid intermediate transfer surface to form an ink image thereon. A final receiving substrate such as paper is then brought into contact with the intermediate transfer surface, and the ink image is transferred to the final receiving substrate. The liquid intermediate transfer surface is cleaned and reapplied prior to the next image being formed on the transfer surface.

Ink jet printing systems that utilize a liquid intermediate transfer surface generally require an applicator to apply the desired amount of liquid onto the intermediate transfer support surface. An exemplary applicator of this type is disclosed in co-pending U.S. patent application Ser. No. 08/382,453, entitled INTERMEDIATE TRANSFER SURFACE APPLICATION SYSTEM and assigned to the assignee of the present application. This application discloses an applicator that is housed in a replaceable transfer drum maintenance cassette. The applicator uses a wick assembly as a contact medium to concurrently apply the liquid onto the intermediate transfer support surface and to remove foreign matter from the support surface. Specifically, as the support surface or transfer drum rotates, the wick assembly is moved into stationary contact with the rotating transfer drum. In this manner, relative motion is created between the rotating transfer drum and the stationary wick such that the transfer drum brushes or rubs against the wick. This allows the wick to contact and remove foreign matter and debris from the drum. However, it also allows debris to accumulate at the point of contact between the drum and the wick, which can interfere with the application of liquid to the drum. This applicator assembly also includes a hydrodynamic wiper blade that uniformly meters and distributes the liquid intermediate transfer surface over the transfer drum.

A supply of liquid for the wick is maintained in two separate oil filled bladders adjacent to the applicator assembly. The release of the oil from the oil bladders is actuated by the movement of the wick assembly upwardly along a valve opening track as the wick assembly moves toward the transfer drum support surface. This movement opens a valving system that allows oil to flow from the bladders through oil access cross bores and spool valve bodies and into a channel that contains the wick. From the channel the oil is wicked upwardly to the upper portion of the wick that contacts the transfer drum.

Prior to installation of the drum maintenance cassette in a printer, the wick is dry, the valving system is closed and the oil does not flow from the bladders to the wick. Upon insertion of the cassette into a printer, the valving system is opened as described above and the oil begins flowing to the wick. To allow the wick to become sufficiently saturated with the oil for proper operation, printing is disabled for a predetermined period, designated the "time-to-first-print," after a new cassette is inserted in a printer.

In addition to the "time-to-first-print" delay and accumulation of debris at the wick/drum contact point, the prior art offset ink jet printing systems that utilize a liquid intermediate transfer surface applicator assembly, such as the one described above, have other limitations in their performance and operation. With the stationary wicking contact medium that creates relative motion with the rotating transfer drum, the amount of fluid delivered by the contact medium can be inconsistent and may vary over time. Where an oil is used as the liquid for the intermediate transfer surface, it is especially important to have a simple and reliable, yet relatively inexpensive and manufacturable applicator assembly that does not leak or erratically dispense the oil. Containment of oil in an applicator assembly that may be removed from the printer after actual use has commenced can be a problem. For example, in the '453 application described above, oil pools in the bottom of the wick channel and may spill from the channel if the cassette is tilted for an extended period after actual use has begun. This is especially true where the wick has been saturated for an extended period and a substantial pool of oil has accumulated in the wick channel.

Furthermore, insufficient control over the distribution and thickness of the liquid intermediate transfer surface has negative effects on printed image quality. Non-uniform film distribution or improper film thickness around the drum results in undesirable image artifacts. Those areas of the surface that have more fluid may be visible on the image as low gloss spots or streaks. If the intermediate transfer surface becomes too thin or is absent, ink can adhere to the drum and not be transferred. This problem becomes even more critical when the final receiving surface for the image is an overhead transparency. In this case, projection of the printed image magnifies areas of non-uniform fluid distribution.

In systems utilizing bladders or other reservoirs to supply liquid to a contact medium, the bladders or reservoirs must be refilled when their supply of liquid has been exhausted. This creates the possibility for spilling liquid during the refilling process. Additionally, the surface of the contact medium may deteriorate to the point that its application and cleaning functions are impaired. In this case, the contact medium must also be replaced, which generally requires an entire replacement drum maintenance cassette.

What is needed is a replaceable liquid intermediate transfer surface application system that overcomes the drawbacks of the prior art. The replaceable application system should be mechanically simple, have a low manufacturing cost and complexity and incorporate a minimum number of components. The system should eliminate any "time-to-first-print" delay and reliably deliver a precise amount of liquid to the intermediate transfer support surface. It is also desirable that this system include a self-contained and easily replaceable contact medium and liquid supply that may be conveniently removed and replaced by an operator without replacing the entire maintenance cassette to thereby reduce waste. The contact medium liquid/supply should also reliably contain the liquid and eliminate any risk of leak or spill, regardless of cassette orientation.

SUMMARY OF THE INVENTION

It is an aspect of the present invention to provide an improved, self-contained liquid application system for applying a liquid intermediate transfer surface to a support surface in an offset ink jet printer.

It is another aspect of the present invention that the liquid intermediate transfer surface is applied by a rotatable liquid impregnated arcuate surface that is formed from a compliant material for improved application consistency.

It is another aspect of the present invention that the liquid impregnated arcuate surface engages in rolling contact with a rotating support surface such that there is no relative motion at the point of contact between the arcuate surface and the support surface.

It is another aspect of the present invention that the liquid application system is contained in a replaceable cassette that is easily inserted and removed from the printer.

It is yet another aspect of the present invention that the liquid application system includes a reclamation assembly that reclaims liquid from the support surface, filters the liquid and supplies the reclaimed liquid back to the arcuate surface for reapplication to the support surface.

It is still another aspect of the present invention that the reclamation assembly utilizes articulated liquid receiving elements that substantially eliminate the possibility of leaks or spills when the cassette is tilted or jolted.

It is a feature of the present invention that the liquid impregnated arcuate surface and the reclamation assembly are housed in a removable cartridge that is individually replaceable.

It is another feature of the present invention that the replaceable cartridge easily snap-fits into the cassette and is easily removed by an operator.

It is another feature of the present invention that the replaceable cassette includes operator-friendly finger wells that assist an operator in removing the cartridge, and the cartridge includes push tabs for convenient insertion and removal of the cartridge.

It is still another feature of the present invention that the cassette includes a replaceable life status assembly for determining the remaining useful life of the cartridge and storing other information.

It is an advantage of the present invention that the replaceable cartridge and overall liquid application system are mechanically simple and eliminate the need for valving and liquid supply/transfer components that can leak.

It is another advantage of the present invention that the arcuate surface applies liquid to the support surface with no relative motion at the point of contact to prevent accumulation of debris at the point of contact.

It is yet another advantage of the present invention that the arcuate surface is continuously cleaned through contact with the articulated liquid receiving elements in the reclamation assembly during application of the liquid to the support surface.

It is another advantage of the present invention that the liquid impregnated arcuate surface has an increased liquid retention capacity for longer useful life as compared to the application systems of the prior art that utilize liquid containing bladders and separate liquid supply components.

It is another advantage of the present invention that the liquid impregnated arcuate surface is saturated prior to initial use and is immediately functional upon insertion into a printer, thereby eliminating any "time-to-first-print" delay for contact medium saturation.

To achieve the foregoing and other aspects, features and advantages, and in accordance with the purposes of the present invention as described herein, an improved replaceable liquid application system is provided. The liquid application system utilizes a liquid impregnated arcuate surface that applies a liquid intermediate transfer surface to a support surface in a printer. The liquid impregnated arcuate surface engages in rolling contact with the support surface such that there is no relative motion at the point of contact between the arcuate surface and the support surface. This assures an even and consistent application and distribution of liquid on the support surface.

The liquid application system includes a removable cartridge that contains the liquid impregnated arcuate surface and a reclamation assembly for filtering and recycling reclaimed oil from the support surface. The cartridge is removably retained in a cassette that is removably retained in the printer. A separate life status assembly determines when the useful life of the liquid impregnated arcuate surface has been exhausted. When this occurs, an operator simply replaces the removable cartridge and life status assembly. Push tabs on the cartridge and finger wells on the cassette allow for easy and convenient removal and insertion of a cartridge.

Still other aspects of the present invention will become apparent to those. skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DESCRIPTION OF THE PREFERRED EMBODIMENT

Figure 1:
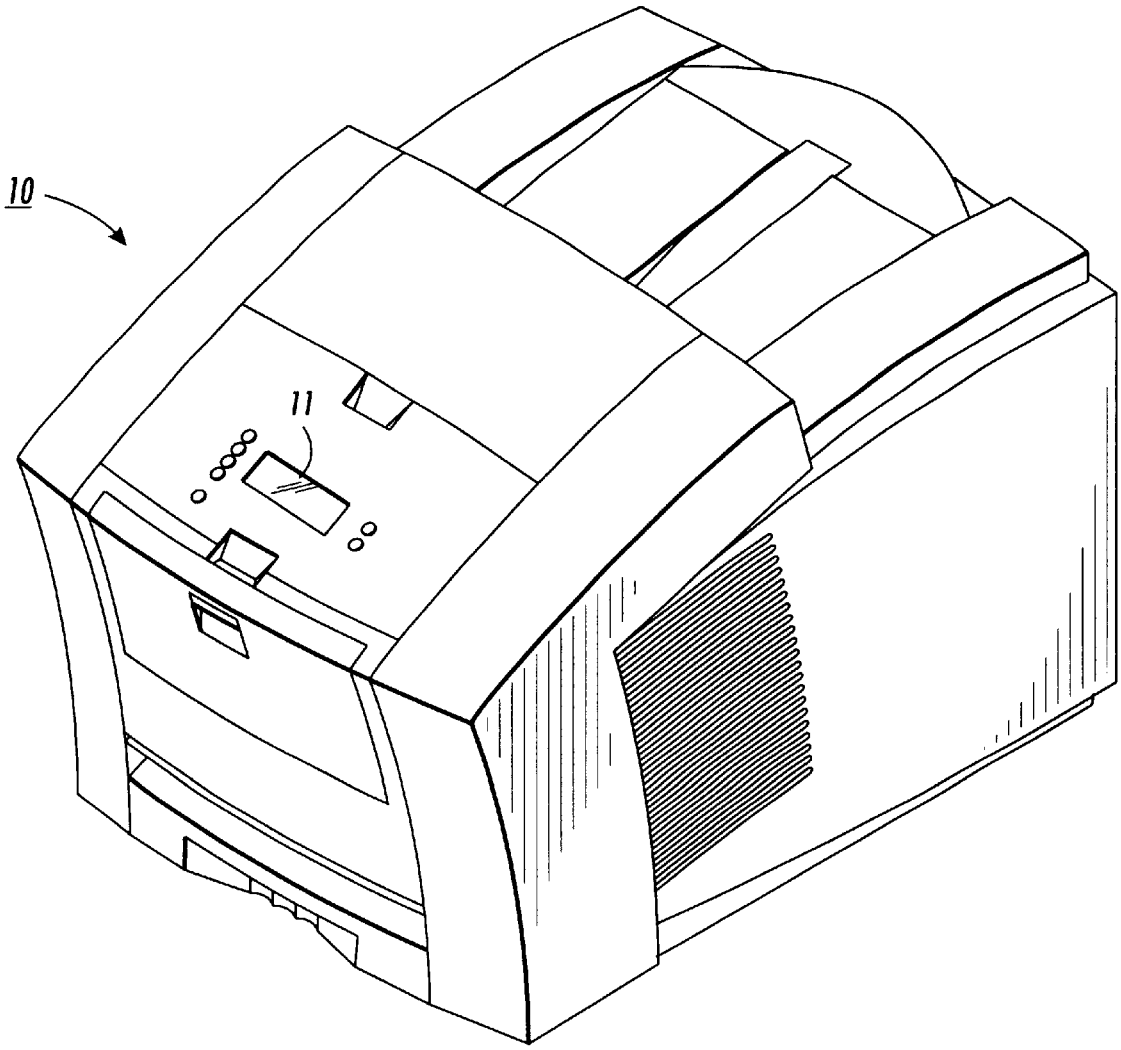
FIG. 1 is an overall perspective view of a phase change ink offset color printer that utilizes the liquid application system of the present invention.

FIG. 1 is an overall illustration of a phase change ink printing apparatus, generally indicated by the reference numeral 10, that utilizes the liquid application system of the present invention. As referenced above, the liquid application system of the present invention is utilized to apply a liquid intermediate transfer surface to an intermediate transfer support surface in an offset printing apparatus. An example of solid ink or phase change ink offset imaging technology is disclosed in U.S. Pat. No. 5,389,958 entitled IMAGING PROCESS and assigned to the assignee of the present application. The '958 patent is hereby specifically incorporated by reference in pertinent part.

The following description of a preferred embodiment of the liquid application system of the present invention refers to its use in the type of phase change ink offset printing apparatus described in the '958 patent. It will be appreciated, however, that the present application system may be used with various other imaging and printing apparatus that utilize different imaging technologies and/or architectures and require the application of an intermediate liquid transfer surface. Accordingly, the following description will be regarded as merely illustrative of one embodiment of the present invention.

Figure 2:
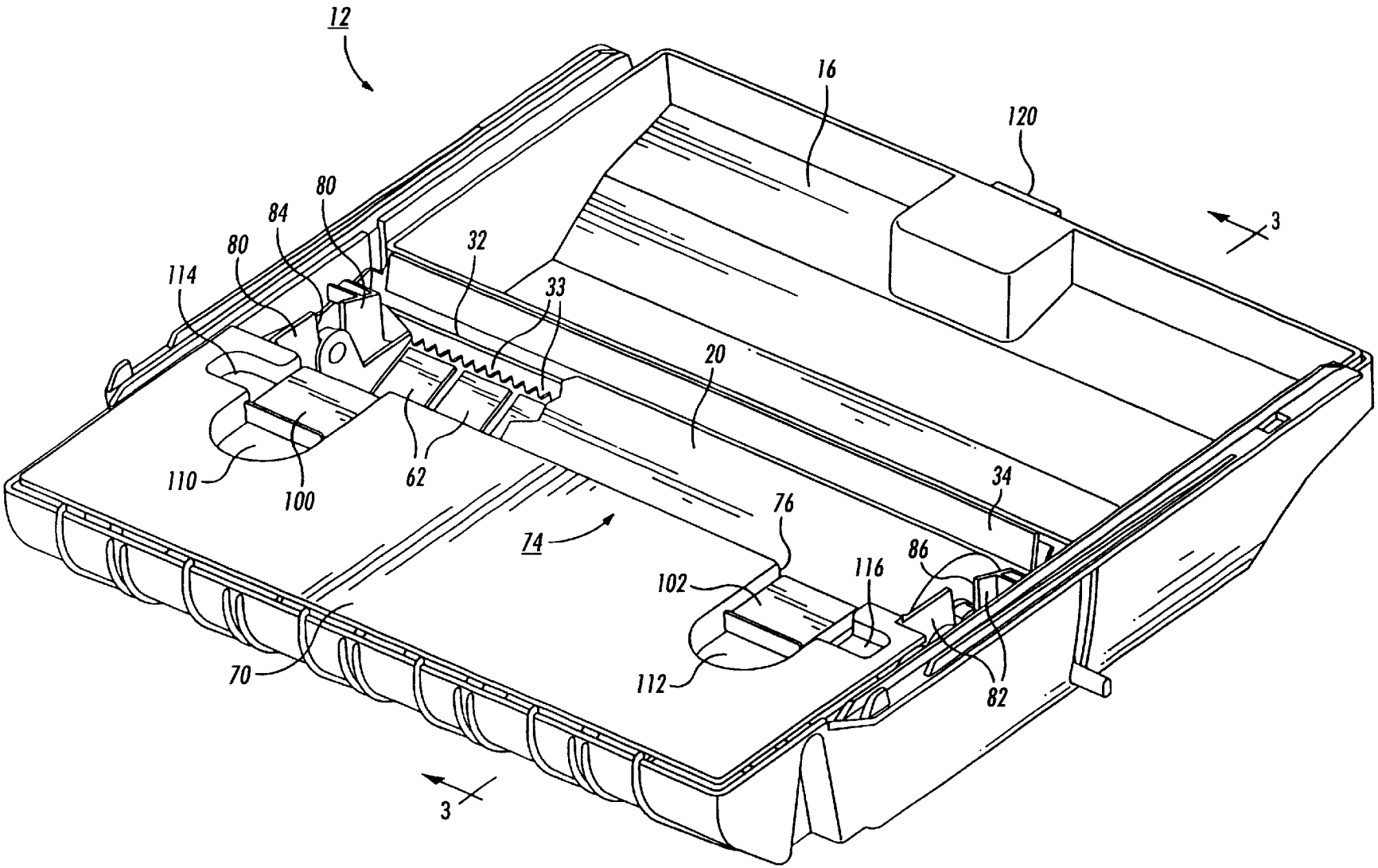
FIG. 2 is a perspective view of a replaceable cassette that is inserted into the color printer of FIG. 1 and contains the liquid application system of the present invention, a portion of the roller in the cassette being cut away to reveal articulated liquid receiving elements below.

FIG. 2 illustrates a replaceable cassette 12 that utilizes the liquid application system of the present invention to apply a liquid intermediate transfer surface to a support surface in an offset ink-jet printer. The cassette 12 includes a removable waste ink receptacle 16 for collecting waste ink from the print head (not shown) in the printer. As explained more fully below, in the preferred embodiment the cassette 12 includes a removable cartridge containing a liquid impregnated arcuate surface for applying the intermediate liquid transfer surface to the support surface in the printer 10.

Figure 3:
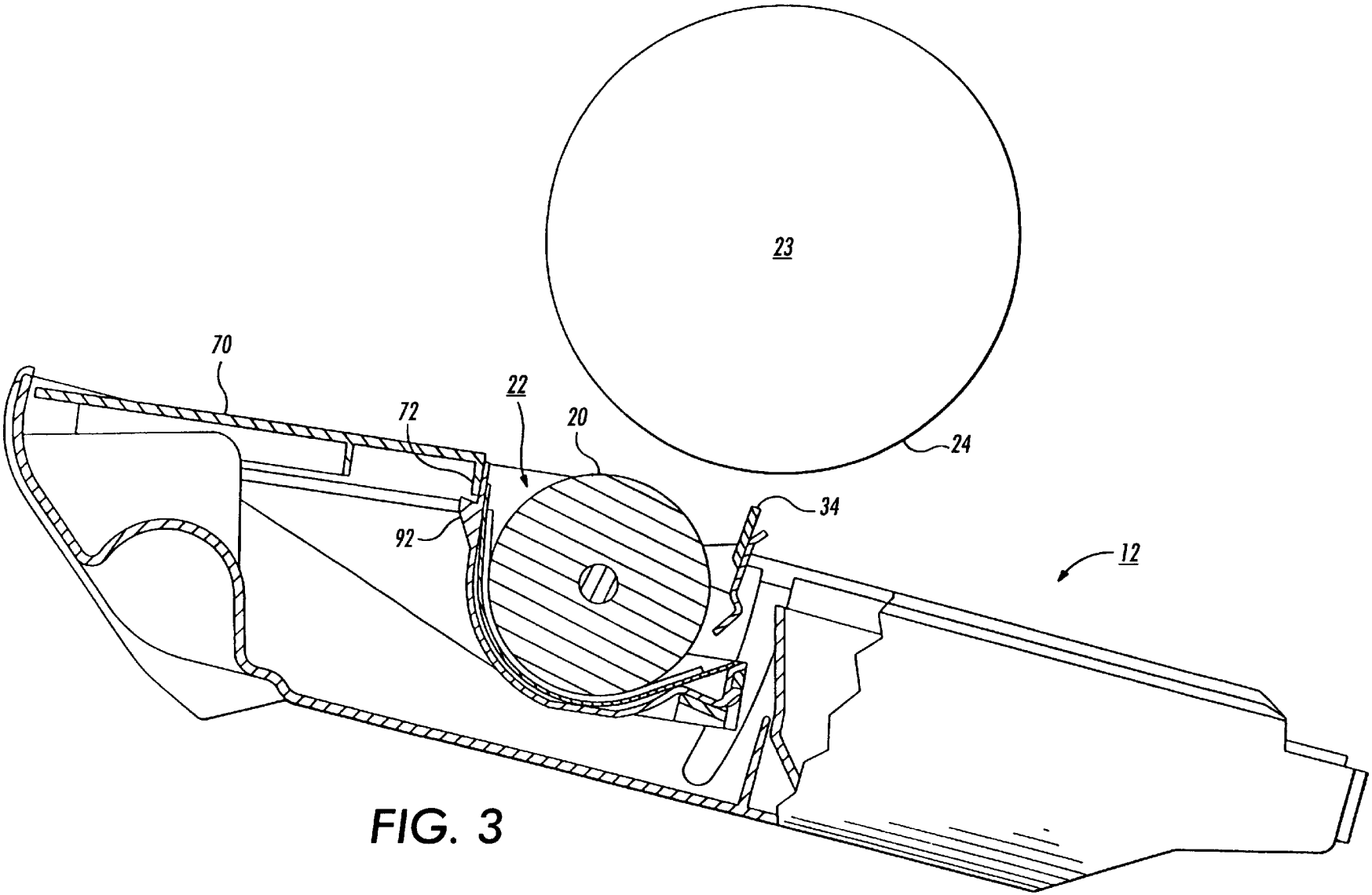
FIG. 3 is a side elevational view of the cassette taken along the section line 3—3 in FIG. 2 showing the liquid application system in a park position adjacent to the transfer drum in the printer.

With reference now to FIG. 3, a sectional side view of the replaceable cassette 12 of the present invention in a first, "park" position is provided. The cassette 12 is shown positioned adjacent to the intermediate transfer support surface in the printer. The intermediate transfer support surface may take the form of a transfer drum 23 as shown in FIG. 3, or alternatively may be a belt, web, platen or other suitable design. The removable cartridge is generally indicated by the reference numeral 22 (see briefly FIG. 5) and includes a liquid impregnated arcuate surface, preferably in the form of a roller 20. In the "park" position illustrated in FIG. 3, the liquid impregnated roller 20 is partially elevated from the cassette 12 and is not in contact with the transfer drum 23.

Figure 4:
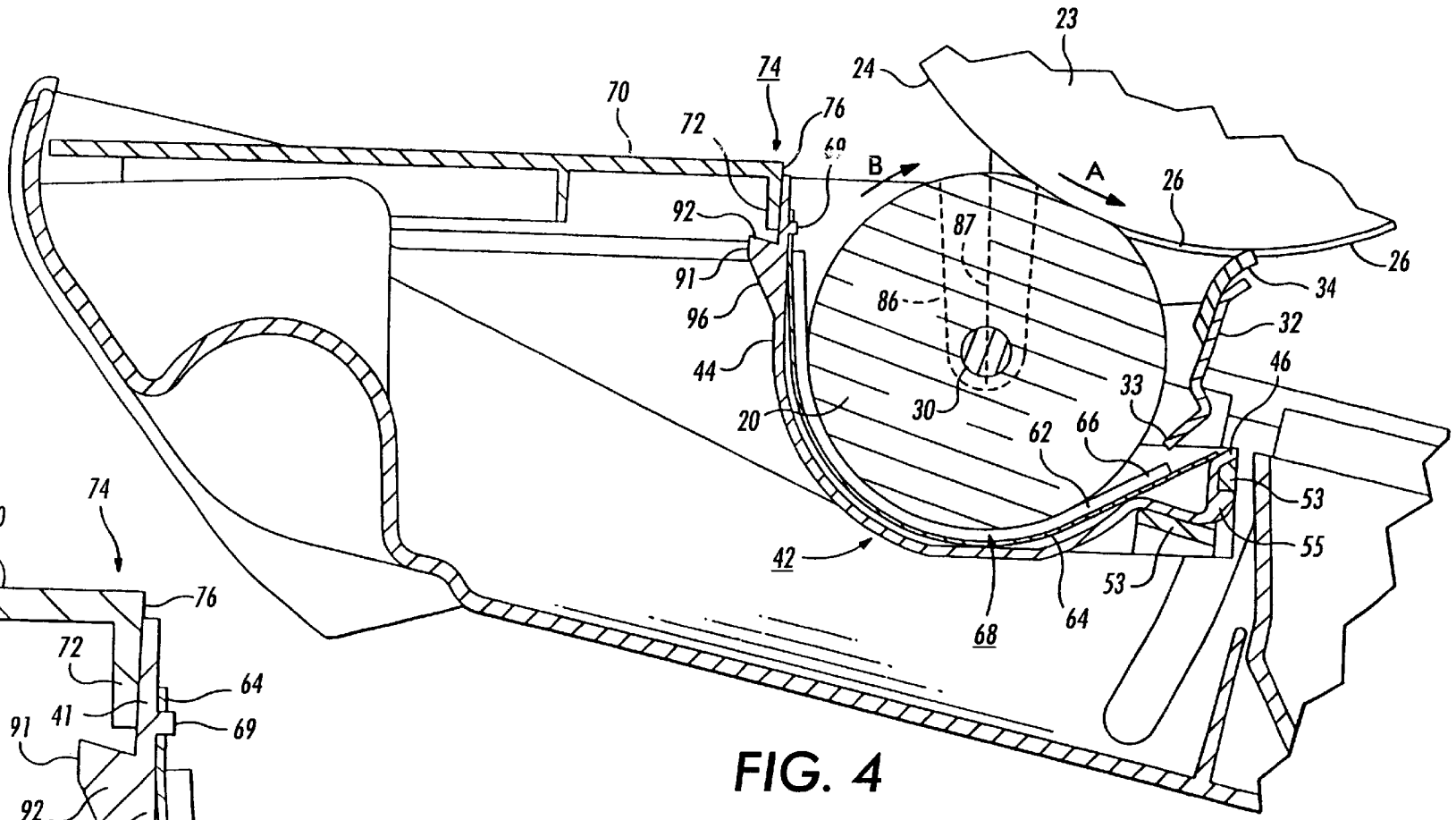
FIG. 4 is an enlarged partial side elevational view showing the roller and blade being elevated from the cassette to an apply position in which the roller and blade engage the transfer drum and apply a liquid intermediate transfer surface to the drum.

With reference now to FIG. 4, prior to imaging the liquid impregnated roller 20 is raised to contact and apply a liquid intermediate transfer surface 26 to the surface 24 of the transfer drum 23. In the preferred embodiment, the roller 20 is formed from an absorbent material, such as extruded polyurethane foam. The polyurethane foam preferably has an oil retention capacity (volume of oil/volume of foam) of at least 60 percent, and most preferably 70 percent, and a capillary height of at least nine inches. The preferred roller 20 has an outer diameter of 1.75 inches (44.45 mm), a length of 8.24 inches (209.3 mm) and is mounted on a shaft 30 having a diameter of 0.375 inches (9.53 mm). Advantageously, by forming the roller 20 from a material having a capillary height that is greater than the length of the roller, it is assured that a fully saturated roller will not leak or drip, regardless of orientation.

With continued reference to FIG. 4, the cassette 12 also includes a metering blade 34 that distributes the liquid intermediate transfer surface 26 across the surface 24 of the transfer drum 23 to consistently provide a uniform liquid layer on the drum surface. In the preferred embodiment, the blade 34 is comprised of an elastomeric material and is affixed to an elongated blade mounting bracket 32. As recited above, the function of the liquid impregnated roller 20 and the elastomeric blade 34 is to apply a finely metered amount of liquid to the transfer drum surface 24.

In operation, the transfer drum 23 rotates in the direction of action arrow A as the liquid impregnated roller 20 and blade 34 are raised into contact with the transfer drum surface 24. The roller 20 is driven to rotate in the direction of action arrow B by frictional contact with the transfer drum surface 24 and applies the liquid intermediate transfer surface 26 to the drum surface 24. Advantageously, as the roller 20 rotates as it applies liquid to the drum surface 24, the point of contact on the roller 20 is continuously moving such that a fresh portion of the roller 20 is continuously contacting the drum surface to apply the liquid. As the liquid intermediate transfer surface 26 on the drum surface 24 reaches the blade 34, the blade 34 then meters the liquid to evenly distribute a uniform liquid layer across the drum surface 24.

Once the application of the liquid intermediate transfer surface 26 is complete, the print head (not shown) jets an ink image on top of this liquid surface. The ink image is then transfixed to a final receiving medium, such as paper, by pressing the paper against the transfer drum 23 with a rotating transfix roller (not shown). The liquid intermediate transfer surface 26 acts as a sacrificial layer which can be at least partially transferred with the ink image to the final receiving medium. Suitable liquids that may be used as the liquid intermediate transfer surface 26 include water, fluorinated oils, glycol, surfactants, mineral oil, silicone oil, functional oils and combinations thereof. Functional oils can include, but are not limited to, mercapto-silicone oils, fluorinated silicone oils and the like. The preferred liquid is amino silicone oil. The final print medium may be a transparency, paper or other suitable media.

The accuracy of the application and distribution of the liquid intermediate transfer surface 26 on the transfer drum surface 24 is critical because of its profound effects on print quality. If the amount of liquid applied and/or metered is too small, the jetted ink will stick to the drum surface 24 and result in cracking on the media or possibly transfix failure. If the amount of liquid applied and/or metered is too large, the jetted ink will "float" on the liquid layer and result in blurring and distortion of the printed image.

With reference to FIG. 4, the blade 34 functions to meter the correct amount of oil onto the drum surface 24 and to capture paper fibers, untransfixed pixels and other debris. The oil impregnated roller 20 applies enough oil to the drum surface 24 to maintain a constant puddle or "oil bar" in front of the blade 34 to insure that there is always a sufficient amount of oil available to be metered. In operation, the debris captured by the blade 34 becomes trapped in the oil bar and flows down the blade as described in more detail below. As the blade 34 meters the oil, the blade is lifted off the drum surface 24 to allow a metered portion of the oil to flow past the blade. By adjusting the contact force of the blade 34 against the drum surface 24 and the angle of attack of the blade, the desired amount of blade lift is established. In the preferred embodiment, the contact force between the blade 34 and the drum surface 24 is between approximately 2.0 pounds (8.9 N.) and approximately 6.0 pounds (26.7 N.), and most preferably approximately 4.0 pounds (17.8 N.), and the angle of attack between a fully engaged blade in operation (see FIG. 4) and the tangential line of contact on the support surface is approximately 45 degrees.

To further achieve the optimal application and distribution of oil on the transfer drum surface 24, in the preferred embodiment the contact force between the roller 20 and the drum surface 24 is between approximately 8.0 pounds (35.6 N.) and 16.0 pounds (71.2 N.), and most preferably approximately 12.0 pounds (53.4 N.), the area of contact or footprint has a width of between approximately 0.1 inches (2.54 mm) and approximately 0.5 inches (7.62 mm) and a length of approximately 8.2 inches (208.3 mm) and the roller is deformed in a direction of the contact force by an amount between approximately 0.025 inches (0.64 mm) and approximately 0.075 inches (1.9 mm), and most preferably approximately 0.050 inches (1.3 mm).

Figure 5:
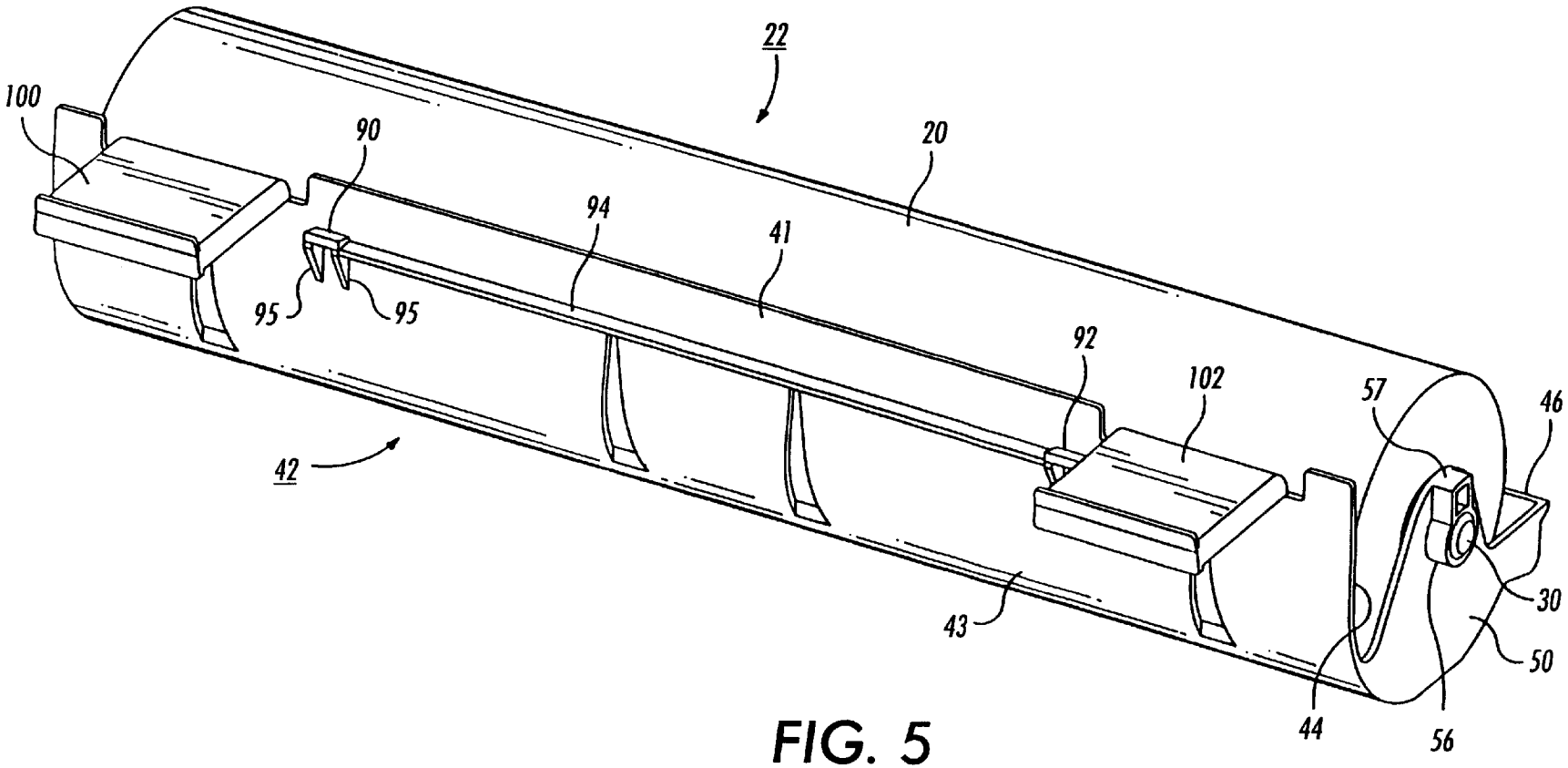
FIG. 5 is a perspective view of the replaceable cartridge that includes the housing, roller and reclamation assembly.
Figure 6:
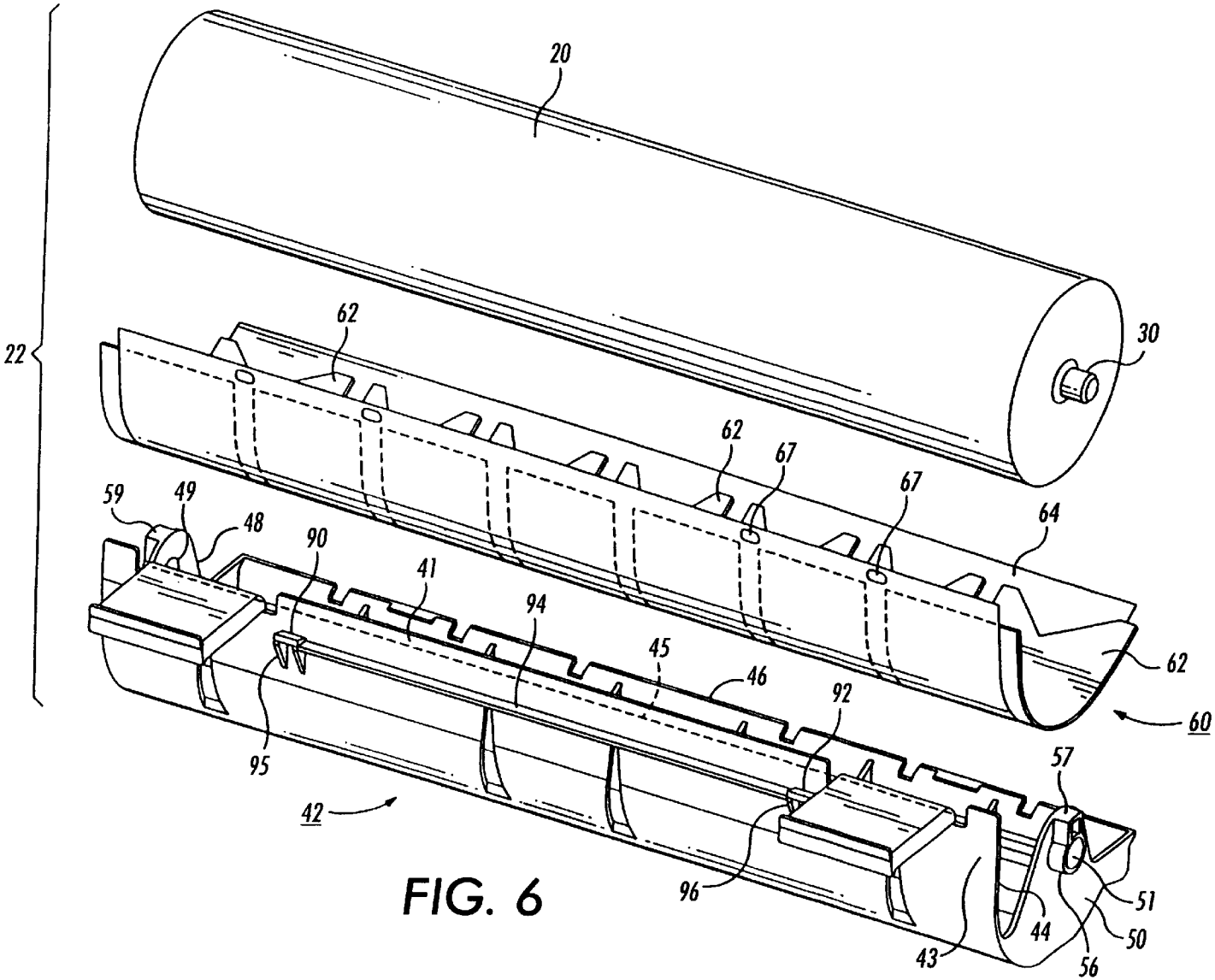
FIG. 6 is an exploded perspective view of the replaceable cartridge showing the roller, reclamation assembly and the housing.

With reference now to FIGS. 5 and 6, and in an important aspect of the present invention, the roller 20 is contained in a removable cartridge, generally designated by the reference numeral 22, which is removably received in the cassette 12 as described in more detail below. The cartridge 22 comprises an elongated arcuate housing 42 that includes a first side 44, a second side 46 and opposing ends 48, 50. A shaft 30 extends from each end of the roller 20 and into apertures 49, 51 that are defined by outwardly protruding cylinders at each end 48, 50 of the housing 42 (only cylinder 56 protruding from end 50 of the housing being visible in FIGS. 5 and 6). In this manner, the roller 20 is rotatably retained within the housing 42.

Figure 4A:
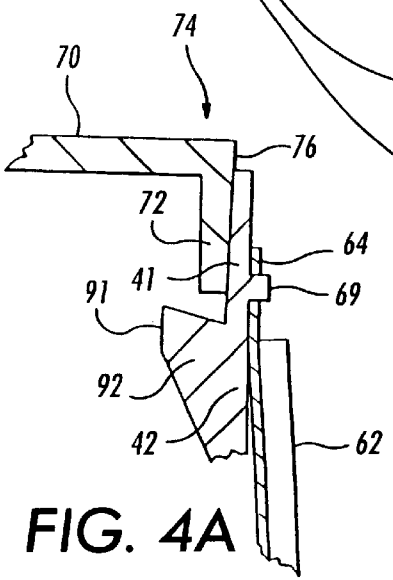
FIG. 4*a* is an enlarged side elevational view of a portion of FIG. 4 showing a tab extending from the housing and through an aperture in the backing surface to retain the backing surface and articulated liquid receiving elements in the housing.

With reference now to FIGS. 4 and 6, the removable cartridge 22 also includes a reclamation assembly, generally designated by the reference numeral 60 in FIG. 6, that recycles reclaimed oil from the drum surface 24, filters debris from the oil and transfers the reclaimed oil to the roller 20 for reapplication to the drum surface. In the preferred embodiment, the reclamation assembly 60 includes a series of articulated liquid receiving elements 62 that are mounted on a flexible backing surface 64, such as mylar. In the preferred embodiment, the articulated liquid receiving elements 62 are formed of a synthetic non-woven textile, such as a polyester felt. As best seen in FIG. 4, the backing surface 64 and articulated liquid receiving elements 62 conform to the arcuate interior of the housing 42 and the roller 20. As shown in FIG. 6, the backing surface 64 includes slots 67 that receive tabs 69 protruding from an upper end 41 of the housing 42 (see FIGS. 4 and 4*a*). The tabs 69 prevent the backing surface 64 from being pushed out of the housing 42 due to frictional contact between the rotating roller 20 and the articulated liquid receiving elements 62. Preferably, the backing surface 64 embodies a shape-retention characteristic that favors a flat profile. In this manner, when the backing surface 64 is bent into a curved profile and pressed into the housing 42 by the roller 20 as shown in FIG. 4, the backing surface biases the articulated liquid receiving elements 62 into contact with the roller 20 to facilitate the transfer of reclaimed oil from the liquid receiving elements to the roller 20, as now will be described.

With reference now to FIG. 4, in operation excess oil 26 and debris trapped within the oil, such as paper fibers, untransfixed ink pixels and the like, flow down the blade 34 and blade mounting bracket 32 and drip onto a receiving portion 66 of a liquid receiving element 62. Preferably, the blade mounting bracket 32 includes multiple downwardly directed drip points 33 from which the excess oil and entrained debris drip. As partially shown in FIG. 2, the drip points 33 extend across the length of the mounting bracket 32 to evenly distribute the excess oil to the several articulated liquid receiving elements 62 in the reclamation assembly 60.

As the excess or reclaimed oil and entrained debris drips onto the receiving portion 66 of the liquid receiving element 62, it begins to flow by gravity toward a bottom portion 68 of the liquid receiving element 62. As the oil flows through the polyester felt of the receiving elements 62, the polyester fibers within the felt filter the oil by trapping and retaining debris while simultaneously allowing the oil to flow toward the bottom portion 68 of the receiving element. Advantageously, the receiving portions 66 of the liquid receiving elements 62 filter the debris from the reclaimed oil before the oil comes into contact with the roller 20. In this manner, the reclaimed oil that is transferred back to the roller 20 has been filtered to remove the debris captured by the blade 34 and the filtered debris accumulates in the receiving portions 66 of the liquid receiving elements 62 away from contact with the roller surface 24. Additionally, by recycling the reclaimed oil back into the roller 20, the reclamation assembly significantly increases the useable life of the roller 20 and the removable cartridge 22.

In another important aspect of the present invention, the elongated arcuate housing 42 containing the oil impregnated roller 20 and the reclamation assembly 60 is easily removable for replacement when the useful life of the roller 20 has been exhausted. In this manner, the rest of the cassette 12 may typically be utilized for the life of the printer 10. Advantageously, this reduces the amount of waste generated by using the liquid application system of the present invention.

With reference now to FIGS. 2, 4 and 5, in the preferred embodiment the removable cassette 12 includes a cover plate 70 that has a downwardly depending segment 72 on a first side 74. The depending segment 72 is spaced apart from and extends substantially parallel to the blade 34, and includes an outer portion 76 that faces the blade (see FIGS. 4 and 4*a*). As best seen in FIG. 2, the cassette also includes first and second side walls 80, 82 that extend laterally from opposite ends of the cover plate 70 toward the blade 34. As best seen by comparing FIGS. 2 and 4, the cover plate segment 72, the blade 34 and the first and second side walls 80, 82 form an opening that receives the housing 42, including the roller 20.

Figure 7:
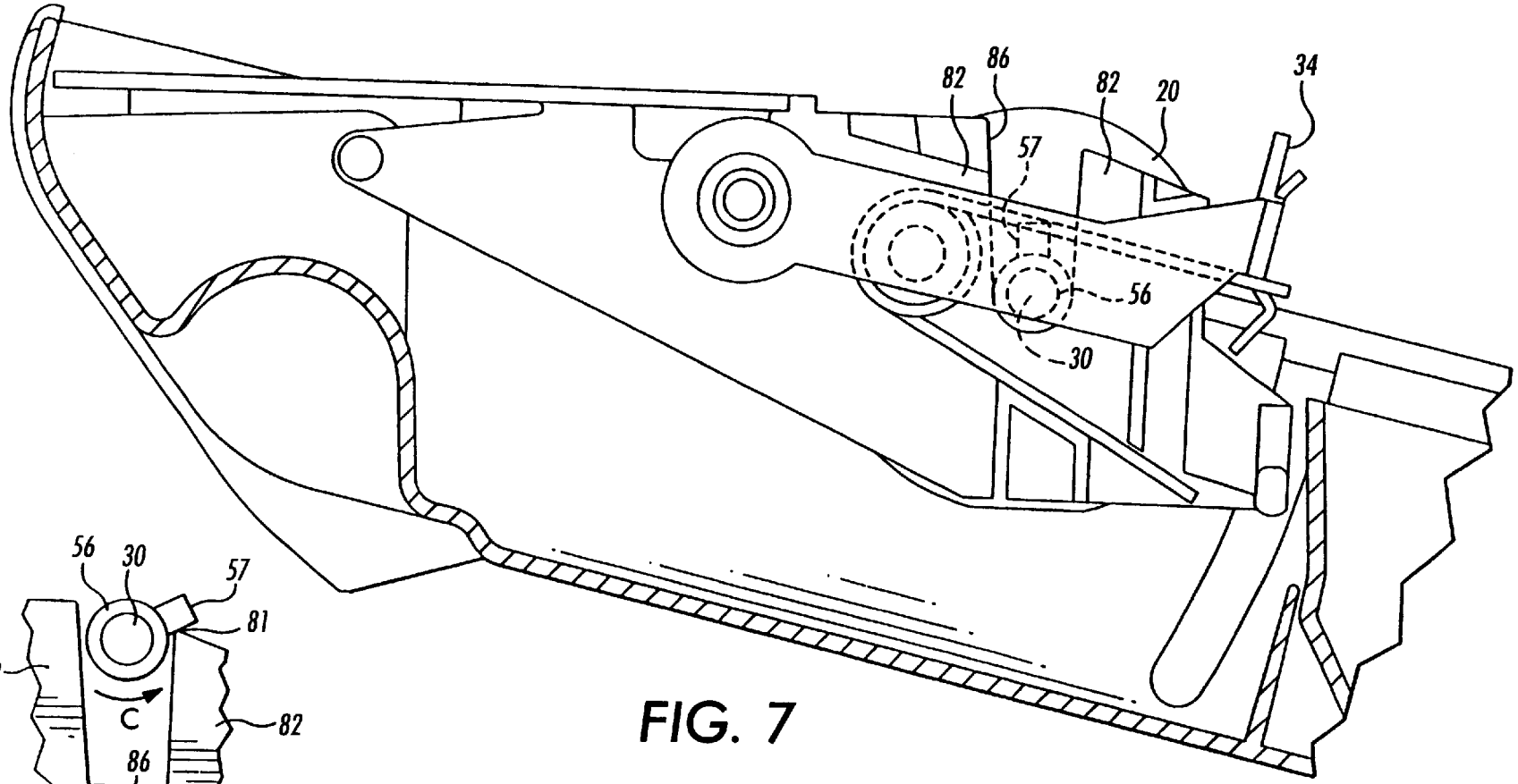
FIG. 7 is a partial side elevational view of the cassette prior to its insertion into the printer showing the liquid application system in the apply position.

With reference now to FIGS. 2, 5 and 7, the first and second side walls 80, 82 each include a slot 84, 86 that is open at an upper end to receive one of the cylinders protruding from each end 48, 50 of the housing 42. As best illustrated in the side view of FIG. 7 showing the second side wall 82 and slot 86, the slots 84, 86 serve as a guide to lead the housing 42 downwardly into the opening 84 until the cylinders reach the bottom of each slot (only slot 86 and cylinder 56 being visible in FIG. 7). With reference to FIGS. 5–7, a cam surface 57, 59 extends from each of the cylinders at each end 48, 50 of the housing 42. The cam surfaces 57, 59 guide an operator during insertion of the cartridge 40 to assure that the cartridge is properly oriented and retained in the cassette 12. With reference to FIG. 4, the width of the housing 42 between its first and second sides 44, 46 is greater than the distance across the opening defined by the blade 34 and the depending segment 76. Thus, an operator must rotate the housing 42 so that the second side 46 enters the opening first, while also aligning the cylinders to enter the slots 84, 86.

Figure 7A:
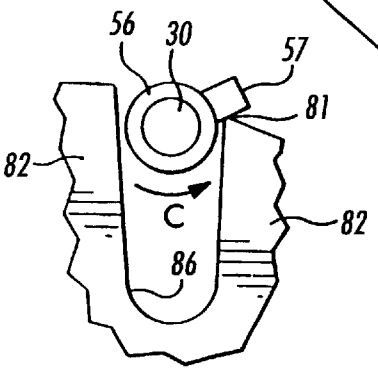
FIG. 7*a* is an enlarged diagrammatic illustration of a cam surface extending from the protruding cylinder and contacting an upper edge of a slot to cause the cylinder and housing to rotate as the cylinder moves downwardly into the slot.

Referring now to FIG. 7*a*, with the housing 42 rotated in this manner the cam surface 57 contacts an upper edge 81 of the slot 86. As the cylinder 56 travels further downwardly in the slot 86, the cam surface 57 causes the cylinder 56 and housing 42 to rotate in the direction of action arrow C. It will be appreciated that the cam surface 59 on the other cylinder on the opposing end 48 of the housing 42 interacts in a similar manner with the slot 84. This controlled rotation causes the second side 46 of the housing 42 to follow a downward arcuate path that directs the second side under the bracket 32 and into engagement with a shelf 53 below the bracket 32 (see FIG. 4). Preferably, the second side 46 includes one or more tabs 55 that mate with corresponding apertures in the shelf 53 to removably retain the housing 42/cartridge 40 in the cassette 12.

With reference now to FIGS. 5 and 6, in an important aspect of the present invention the outer face 43 of the first side 44 of the arcuate housing 42 includes at least one protruding retention tab to further removably secure the cartridge 22 in the cassette 12. In the preferred embodiment, the outer face 43 includes two spaced apart retention tabs 90, 92 and a lip 94 that spans the gap between the seating tabs. Advantageously, as described in more detail below, the retention tabs allow an operator to easily insert and remove the cartridge 22.

Preferably, the arcuate housing 42 is made from a flexible material, such as plastic. Additionally, with reference now to FIGS. 4, 4*a*, and 6, the distance between an outermost portion 91 of tab 92 and the centerline 45 extending between the protruding cylinders is greater than the distance between the vertical centerline 87 of one of the slots 86 and the outer portion 76 of the cover plate segment 72. In this manner, as the housing 42 is inserted into the opening 84 and the protruding cylinders are guided downwardly into the slots 84, 86, the seating tabs 90, 92 contact the outer portion 76 of the cover plate segment 72 prior to the cylinders reaching the bottom of the slots. Preferably, the seating tabs 90, 92 also include ramps 95, 96 to ease the seating tabs onto the outer portion 76 of the cover plate segment 72 as the cartridge 22 is being inserted.

As the cylinders are pushed further down into the slots 84, 86, the contact between the retention tabs 90, 92 and the outer portion 76 of the cover plate segment 72 causes the first side 44 of the housing 42 to flex toward the protruding cylinders to thereby establish a biasing force that presses the retention tabs 90, 92 against the outer portion 76 of the cover plate segment 72. With reference to FIGS. 4 and 5, at the point that the retention tabs 90, 92 reach a position below the cover plate segment 72 such that the housing 42 is fully received in the opening 84, the biasing force causes the housing to "snap" into place with an upper portion 41 of the outer face 43 of the first side 44 of the housing 42 abutting the outer portion 76 of the cover plate segment 72. In this position, the retention tabs 90, 92 extend under the cover plate segment such that the housing cartridge 22 is removably retained in the opening.

With reference now to FIG. 5, to assist an operator in inserting and removing the cartridge 22, the housing 42 includes first and second push tabs 100, 102 that extend laterally from the outer face 43 of the first side 44 of the housing 42. Preferably, the push tab 100, 102 are spaced apart and positioned near opposite ends of the housing 42 with the two retention tabs 90, 92 being between the push tabs. As shown in FIG. 2, the cover plate 70 includes a first finger well 110 into which the first push tab 100 extends and a second finger well 112 into which the second push tab 102 extends when the housing 42 is fully received in the opening. The first and second finger wells 110, 112 each include a leveraging surface 114, 116, respectively, that extends substantially parallel to the cover plate segment 72. To remove a fully inserted removable cartridge 22 from the cassette 12, an operator braces a left-hand finger against the first leveraging surface 114 in the first finger well 110 and presses the first push tab 100 with a left thumb. Simultaneously, the operator braces a right-hand finger against the second leveraging surface 116 in the second finger well 112 and presses the second push tab 102 with a right thumb to move the retention tabs 90, 92 toward the second side 46 of the housing 42 until the tabs are no longer under the cover plate segment 72. At this point, the tabs 100, 102 and cartridge 22 may be lifted upwardly and removed from the opening in the cassette 12. Advantageously, the "snap-fit" of the cartridge 22 into the cassette 12 and the push tabs 100, 102 and finger wells 110, 112 allow for easy operator removal and replacement of a cartridge 22.

Figure 8:
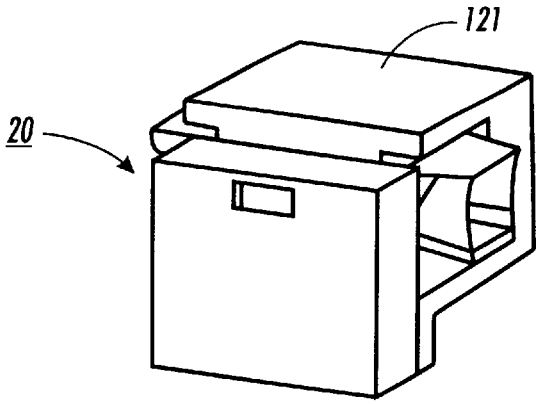
FIG. 8 is a perspective view of a removable life status assembly that is utilized with the cassette.
Figure 9:
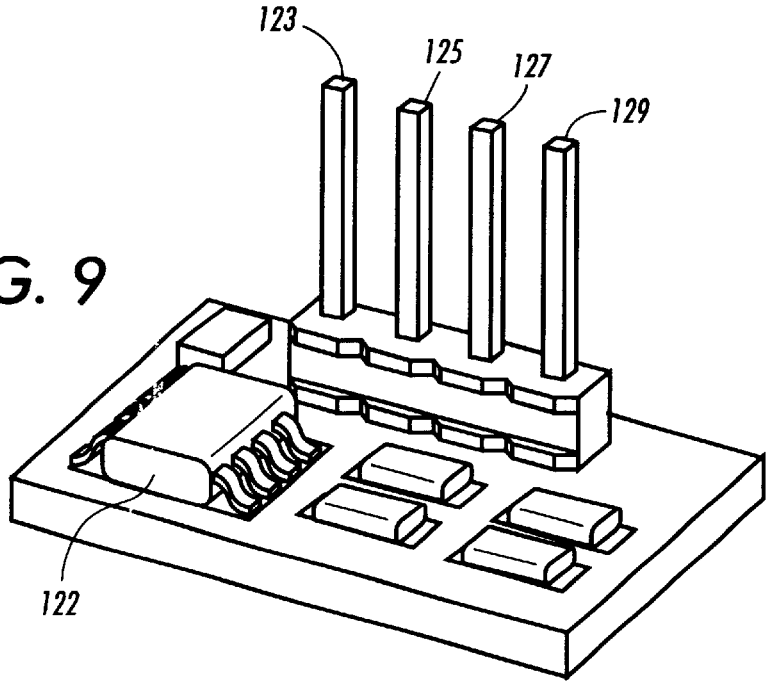
FIG. 9 is an enlarged perspective view of an EEPROM circuit board within the life status assembly and four probes that engage mating receptacles in the printer.

With reference now to FIGS. 2 and 8, to advise an operator of the condition of the cartridge 22, a life status assembly 120 is utilized to determine the condition of the cartridge. In the preferred embodiment, the life status assembly 120 comprises an EEPROM circuit board 122 mounted in a removable plastic receptacle 121 (see also FIG. 9). The receptacle 121 is removeably seated within the cassette 12 underneath the removable waste ink tray 16 (see FIG. 2). The EEPROM 122 is electrically connected to the printer 10 when the cassette 12 is fully inserted in the printer. With reference to FIGS. 8 and 9, in the preferred embodiment four probles 123, 125, 127 and 129 within the housing 121 engage mating receptacles (not shown) in the printer 10 when the cassette 12 is inserted in the printer.

Figure 10:
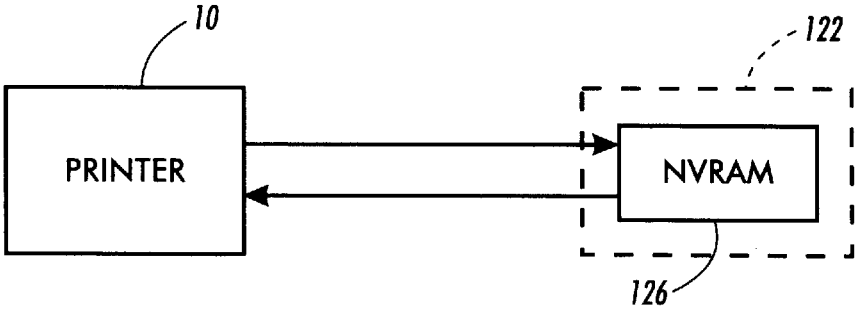
FIG. 10 is a schematic diagram showing the printer communicating with the NVRAM in the EEPROM.

With reference to FIG. 10, the EEPROM 122 includes non-volatile memory (NVRAM) 126 that maintains a count related to the number of images produced by the printer 10. The count is either incremented or 5 decremented as prints are made by the printer 10. When the count reaches one or more predetermined values that are calculated to correspond to particular oil levels in the oil-impregnated roller 20, the printer 10 generates a message on the display panel 11 (see FIG. 1) that advises the operator of the condition of the cartridge 22 (for example, a "low oil condition" or an "end of useful life" condition). In another advantage of the present invention, the predetermined values corresponding to oil levels may be easily modified within the NVRAM 126 by software in the printer 10.

Storing information in NVRAM on the EEPROM 122 also allows the information to reside with the cassette 12. This allows the cassette 12 to be moved and shared among different printers while maintaining the oil condition information for that cassette. It will be appreciated that additional information related to the cassette 12 or the corresponding printer 10, such as the cassette type, cassette initial life, printer start-up requirements or particular support surface conditioning requirements, may also be stored in the NVRAM 126 in the life status assembly 120. It will also be appreciated that other memory sources, such as a battery back-up system, may be utilized. Preferably, the roller 20 and cartridge 22 have a useful life of between 20,000 and 30,000 prints before replacement is necessary. When a cartridge 22 is replaced, a new life status assembly 120 is also provided.

The foregoing description of a preferred embodiment of the invention has been presented for purposes of illustration and description. It is not intended to be exhaustive or to limit the invention to the precise form disclosed. The terms and expressions which have been employed in foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different printing apparatus, other than solid ink offset printer, all without departing from the inventive concepts disclosed herein.

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled. All patents cited herein are incorporated by reference in their entirety.

What is claimed is:

1. A life status assembly for monitoring a life status of a removable cartridge that applies a liquid intermediate transfer surface to a support surface in an imaging apparatus, the life status assembly comprising:

a non-volatile memory source for maintaining information related to a number of images produced by the imaging apparatus, wherein a count related to the number of images produced by the imaging apparatus is incremented for images produced by the imaging apparatus, whereby the life status assembly determines an end of useful life of the removable cartridge.

2. The life status assembly of claim 1, wherein the memory source is contained on an EEPROM circuit board.

3. The life status assembly of claim 2, wherein the EEPROM circuit board exchanges with the imaging apparatus information related to the number of images produced by the imaging apparatus.

4. The life status assembly of claim 3, wherein a count related to the number of images produced by the imaging apparatus is decremented for images produced by the imaging apparatus.

5. In an offset ink-jet printer including a support surface and a replaceable liquid application system for applying a liquid intermediate transfer surface to the support surface, the replaceable liquid application system removably receivable in a cassette that is removably receivable in the printer, the replaceable liquid application system including a liquid impregnated arcuate surface in moving contact with the support surface for applying the liquid intermediate transfer surface to the support surface, a reclamation assembly in fluid communication with said arcuate surface, said reclamation assembly concurrently receiving reclaimed liquid, filtering said reclaimed liquid to remove debris and transferring said reclaimed liquid to the arcuate surface for reapplication to the support surface, and a display for providing information to an operator, the improvement comprising:

a replaceable life status assembly removably retained in the cassette, the life status assembly comprising a memory source for maintaining information related to a number of images produced by the printer, the life status assembly in electrical communication with the printer to provide feedback to the operator through the display in the printer.

6. The offset ink-jet printer of claim 5, wherein the memory source is contained on an EEPROM circuit board.

7. The offset ink-jet printer of claim 6, wherein the EEPROM circuit board exchanges with the printer information related to the number of images produced by the printer.

8. The offset ink-jet printer of claim 7, wherein the memory source comprises non-volatile memory.

9. The offset ink-jet printer of claim 8, wherein a count related to the number of images produced by the printer is decremented for images produced by the printer.

10. The offset ink-jet printer of claim 8, wherein a count related to the number of images produced by the printer is incremented for images produced by the printer.

11. A method for determining estimated remaining life information for a replaceable liquid application system, the liquid application system for applying a liquid intermediate transfer surface to a support surface in an imaging apparatus, the liquid application system being removably receivable in a cassette that is removably receivable in the imaging apparatus, the method comprising the steps of:

providing a replaceable life status assembly in the cassette;

counting a number of images produced by the imaging apparatus;

storing in non-volatile memory life status assembly information related to the number of images produced by the imaging apparatus;

incrementing a counter for images produced by the imaging apparatus; and determining when an estimated remaining life of the replaceable liquid application system is in a low condition.

12. The method of claims 11, wherein the step of counting a number of images further comprises the step of decrementing a counter for images produced by the imaging apparatus.

13. The method of claim 12, wherein the step of storing information in the life status assembly further comprises the step of storing the information on an EEPROM circuit board.

14. The method of claim 13, further including the steps of:

receiving in the EEPROM circuit board information related to the number of images produced by the imaging apparatus, and communicating information related to the number of images produced by the imaging apparatus from the non-volatile memory to the imaging apparatus.

15. The method of claim 14, further including the step of storing in the life status assembly additional information related to the replaceable liquid application system.

* * * * *